US006444915B1

(12) United States Patent
Wang

(10) Patent No.: US 6,444,915 B1
(45) Date of Patent: Sep. 3, 2002

(54) FOLDABLE ELECTRIC CORD ARRANGEMENT AND MANUFACTURE

(76) Inventor: James C. Wang, 10 Sanders Ct., Bluffton, SC (US) 29910

( * ) Notice: Subject to any disclaimer, the term of this patent is extended or adjusted under 35 U.S.C. 154(b) by 0 days.

(21) Appl. No.: 09/792,941

(22) Filed: Feb. 26, 2001

(51) Int. Cl.[7] ..... H01B 7/00
(52) U.S. Cl. ..... 174/110 R; 174/120 R
(58) Field of Search ..... 174/110 R, 110 SR, 174/110 AR, 120 R, 120 SR, 120 AR, 113 R

(56) References Cited

U.S. PATENT DOCUMENTS 535,084 A * 3/1895 Still et al. ..... 174/111
3,576,939 A 5/1971 Ziemek
4,396,797 A * 8/1983 Sakuragi et al. ..... 138/110
4,495,134 A * 1/1985 Ouchi et al. ..... 264/516
4,636,346 A * 1/1987 Gold et al. ..... 264/139
4,739,768 A * 4/1988 Engelson ..... 128/658
5,035,596 A * 7/1991 Pohl ..... 425/133.1
5,258,160 A * 11/1993 Utsumi et al. ..... 264/558
5,533,985 A 7/1996 Wang
5,929,374 A * 7/1999 Garland ..... 174/28
6,135,992 A 10/2000 Wang

* cited by examiner

*Primary Examiner*—Dean A. Reichard
*Assistant Examiner*—William H. Mayo, III

(57) ABSTRACT

The present invention relates to an elongated, foldable cable for the communication of electrical power from a source to an electrically powered device. The cable has an elongated electrical conductor, a first insulating material arranged about a first linear segment of the elongated electrical conductor and a second insulating material arranged about a second linear segment of the elongated electrical conductor. The first and second insulating materials are of different flexibility from one another whereby to enable folding on the materials of greater flexibility.

8 Claims, 4 Drawing Sheets

FOLDABLE ELECTRIC CORD ARRANGEMENT AND MANUFACTURE

BACKGROUND OF THE INVENTION

1. Field of the Invention

This invention relates to electrical conductors and more particularly to electrical conductors housed in an extruded plastic material which is arranged to permit the easy folding thereof.

2. Background Prior Art

Electrical conductors such as cables and electrical cords are typically coated with rubber or plastic and are well known in the art. In the basic construction of such cables or wires, the conductor usually is the only metallic part and can be a single or multiple strand surrounded by an enveloping jacket which is usually a unitary plastic composition. Some cables or cords may have a built up construction of two or more plastic or rubber layers extending therealong.

Such electrical cords or conductors are thick and usually found attached to computers, between computers and peripheral devices such as printers or monitors, appliances or tools and portable equipment. Many appliances are purchased with these electric cords or cables neatly wound in a bundle with a tie or packaged with plugs at both ends. With computers and peripheral equipment the cables have male and female ends and are bound together with ties. Removal of the tie causes unfolding of the cable or cord. When it is desired to re-bundle or re-coil the electric cord or cable, it is often difficult to do so in a neat or uniform manner. This is especially true of cables associated with computers and most owners simply maintain a mess of tangled wires hidden behind a desk.

Such hindrance to the neat and uniform re-folding of a power cord or cable is due to the unitary form of layering built up about the central conductive metallic core or cores.

An object of the present invention is to overcome the disadvantages of the prior art.

A further object of the present invention to provide an electric power cable or cord which is easily re-foldable and formed into a bundle so as to permit easy re-wrapping or folding thereof.

Another object of the present invention is to provide an electric power cable or cord which is easily manufactured and economically produced with minimal increased cost for the manufacturer.

Yet another object of the present invention is to provide an electrical conduit for a cable which minimizes kinking and undesired twisting by using a strain relief section.

BRIEF SUMMARY OF THE INVENTION

The present invention relates to the manufacture of an electrical power cable or cord having uniquely flexible properties, for example differential stiffness, in different sections along its length. The cable is to be utilized in conjunction with home appliances and portable equipment. A power cable or conduit made utilizing the principles of this invention has a generally stiff section alternating with a flexible section with a unique transition section of controlled length in repeating sequence axially along the length of the cord. The merging of the two materials forming the stiff sections and the flexible sections are smooth and gradual to eliminate any buckling and kinking that might otherwise occur at abrupt joints between two materials of different stiffness. The average length of a transition section in such a power cable or conduit is about 0.1 to 20 inches, preferably about 0.2 to 10 inches.

The cable of the present invention may be made by means of a co-extrusion process with a co-extrusion head. The co-extrusion head is arranged to minimize volumes of all the flow channels therewithin. Such a flow head is shown and described in my U.S. Pat. Nos. 5,533,985 and 6,135,992, both of which are incorporated herein by reference, in their entirety. The present invention thus provides for the production of an extruded power cable or conduit with an electrical conductor being co-extruded using several thermoplastic resins of varied thicknesses which can be automatically fed into the co-extrusion head and precisely synchronized fashion to produce a power cable or conduit having different resins or resin combinations in different longitudinal sections of the cable, always with gradual transitions from one to the other in short transition sections. A unique characteristic of the invention is the gradual change and the controlled shorter length of the transition section between a soft flexible portion and a stiff portion of the extruded material about the conductive core of the cable, preferably in a wedge-in configuration. A wedged-in construction of the transition section of the power cable or conduit can comprise a layer of one material forming a wedge shaped profile extending into another material. The construction is such that the wall gradually changes from a first material to a second material having less stiffness so that the material gradually changes from a material of a predetermined stiffness to a one of less stiffness to form an unbroken wall of insulating material. This construction is formed by a skewing volume which is not overly short and with a viscosity of the wedging material or resin not overly high when compared with the resin into which it is wedged.

In forming a power cable or conduit of the present invention, one material or resin is always gradually combined with another material in the transition zone with some aspects of the resin forming a wedge structure circumferentially about the central conduit. In other configurations, the wedge may be in the form of a gradually fitting layer or in gradually changing the shapes such as multiple spear points. This wedge construction forms an extremely secure virtually unbreakable joinder between two resins because of the large surface area that also forms the region of greater flexibility of the resin thereof.

The present invention thus comprises an elongated cable for the communication of electrical power from a source to an electrically powered device. The cable comprises an elongated electrical conductor, a first insulating material arranged about a first linear segment of the elongated electrical conductor and a second insulating material arranged about a second linear segment of the elongated electrical conductor. The first and second insulating materials are different from one another. The first and second insulating materials may be thermoplastic resins. The first linear segment and the second linear segment are adjacent one another along the elongated electrical conductor. The elongated electrical conductor has a plurality of first and second segments disposed along its longitudinal length, each of the segments being of different stiffness. The first and second segments are arranged in an alternating sequence with one another along the elongated electrical conductor. The first and second segments may have a transition zone therebetween of increasing flexibility in its longitudinal direction or may have a transition zone therebetween of decreasing flexibility in its longitudinal direction.

The invention also includes a method of manufacturing an insulated electrical power cable with an insulator extruded therearound of alternating flexibility along its length. The method comprises the steps of arranging an extrusion head to receive a conductive wire therethrough, attaching a first and a second insulating material extruder in communication with the head, the first and second insulating material extruders each extruding insulating material of different flexibility from one another when the insulating material is cured, directing the conductive wire through the head and alternatingly extruding the first and second insulating materials to enclose alternating segments of the length of the conductive wire as the conductive wire is drawn from the head. The method includes the steps of tapering the first and second insulating materials with respect to one another in a transition zone juncture between the alternating segments of insulating materials. The insulating segment material may comprise thermoplastic resins.

BRIEF DESCRIPTION OF SEVERAL VIEWS OF THE DRAWINGS

The objects and advantages of the present invention will become more apparent when viewed in conjunction drawings, in which.

DETAILED DESCRIPTION OF THE OF THE INVENTION

Figure 1A:
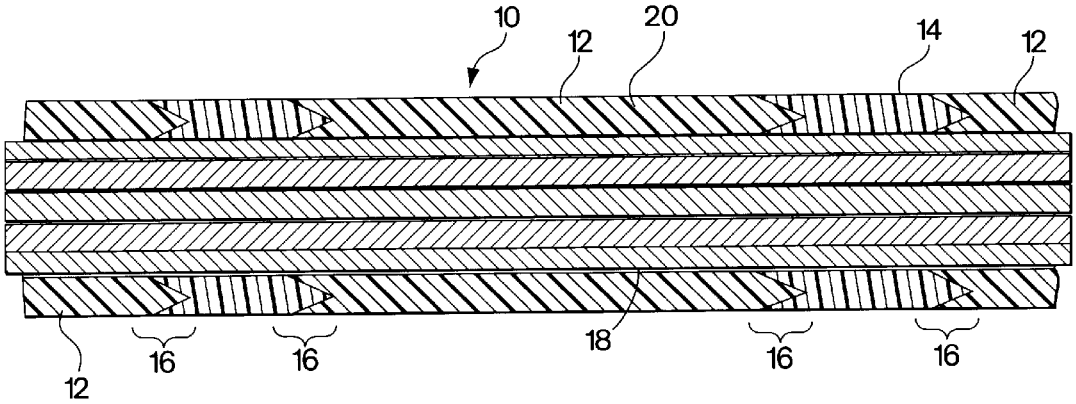
FIGS. 1A and 1B are a side elevational views, partly in section, of a length of electrical power cord constructed according to the principles of the present invention.
Figure 1B:
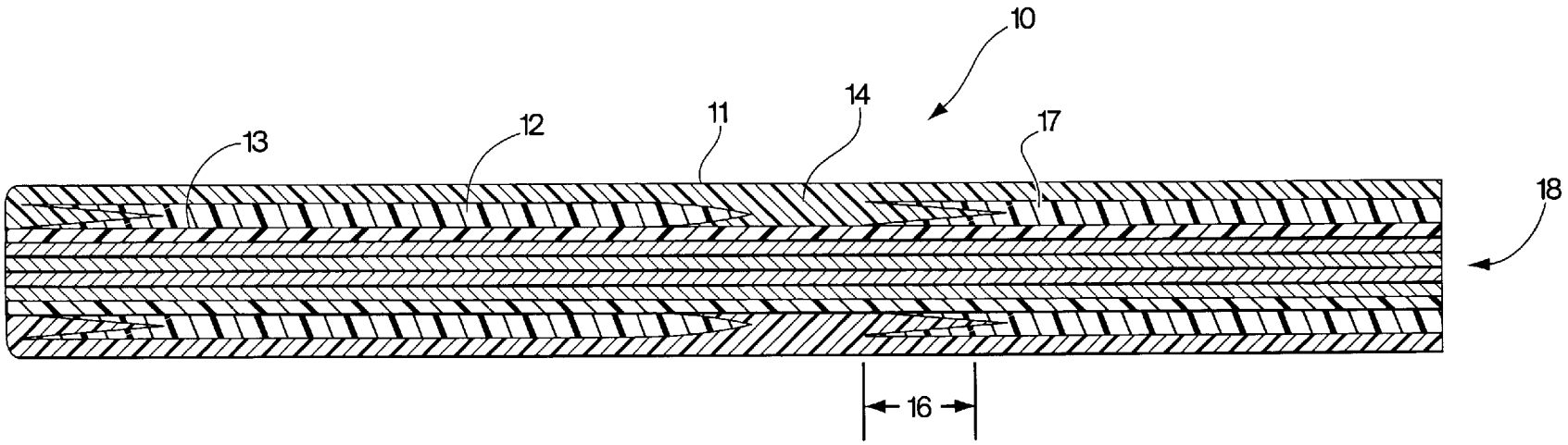
Figure 2:
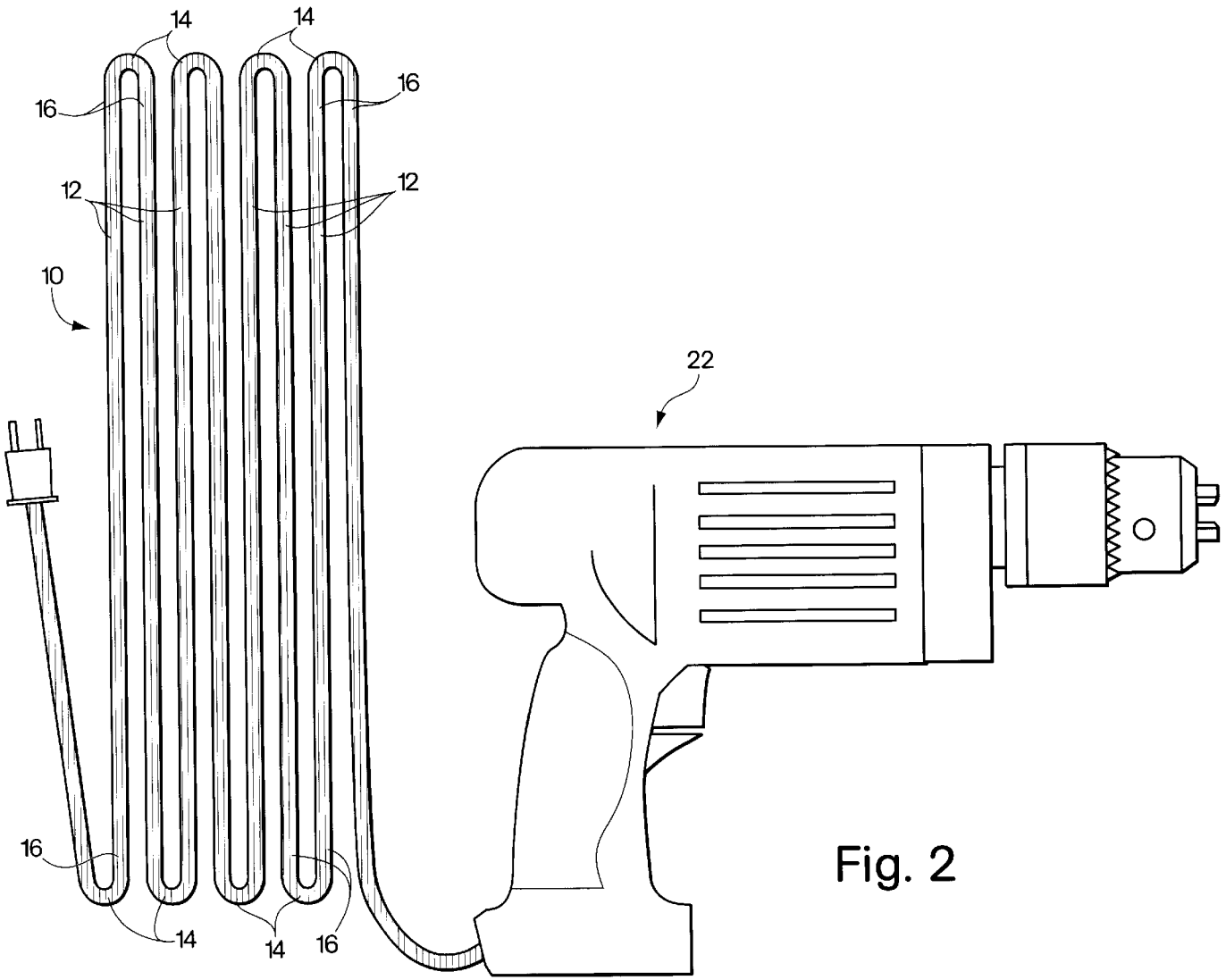
FIG. 2 is a plan view of an electrical power cord attached to a power appliance which consumes power.

Referring now to the drawings in detail, and particularly to FIGS. 1A and 1B, there are shown the present invention that comprises an electrical power cable or cord 10 having uniquely flexible properties in its insulation 20, for example, insulation 20 being of differential stiffness, in different discrete sections along its length surrounding an electrical conductor 18. FIG. 1B differs from FIG. 1A in that insulation segment 11 is continuous over insulation segment 17. Such a cable 10 is to be utilized in conjunction with home appliances, portable equipment, computer cables or other means 22 to conduct electrical power or signals, as is exemplified by FIG. 2.

A power cable or conduit 10 made utilizing the principles of this invention has somewhat elongated annular stiff insulation sections 12 alternating axially with annular flexible insulation sections 14 with a unique transition section 16 of controlled length extending between those sections 12 and 14. The merging of the two insulation materials forming the stiff sections 12 and the alternating flexible sections 14 are smooth and gradual, as seen in section in FIG. 1, to eliminate any buckling and kinking that might otherwise occur at abrupt joints between two insulating materials of different stiffness. In some embodiments, as shown in FIG. 1B, for example, it may be desired to extend the flexible sections 14 partially or totally around the outside of the stiff sections 12 as a partial or total overcoat. The average length of a transition insulation section 16 in such a power cable or conduit 10 is about 0.25 to 20 inches, preferably about 0.5 to 10 inches. In the embodiment shown in FIG. 1B, the stiff segment 17 is extruded so that the flexible segment 11 entirely covers it as an outer jacket along its length.

Figure 3:
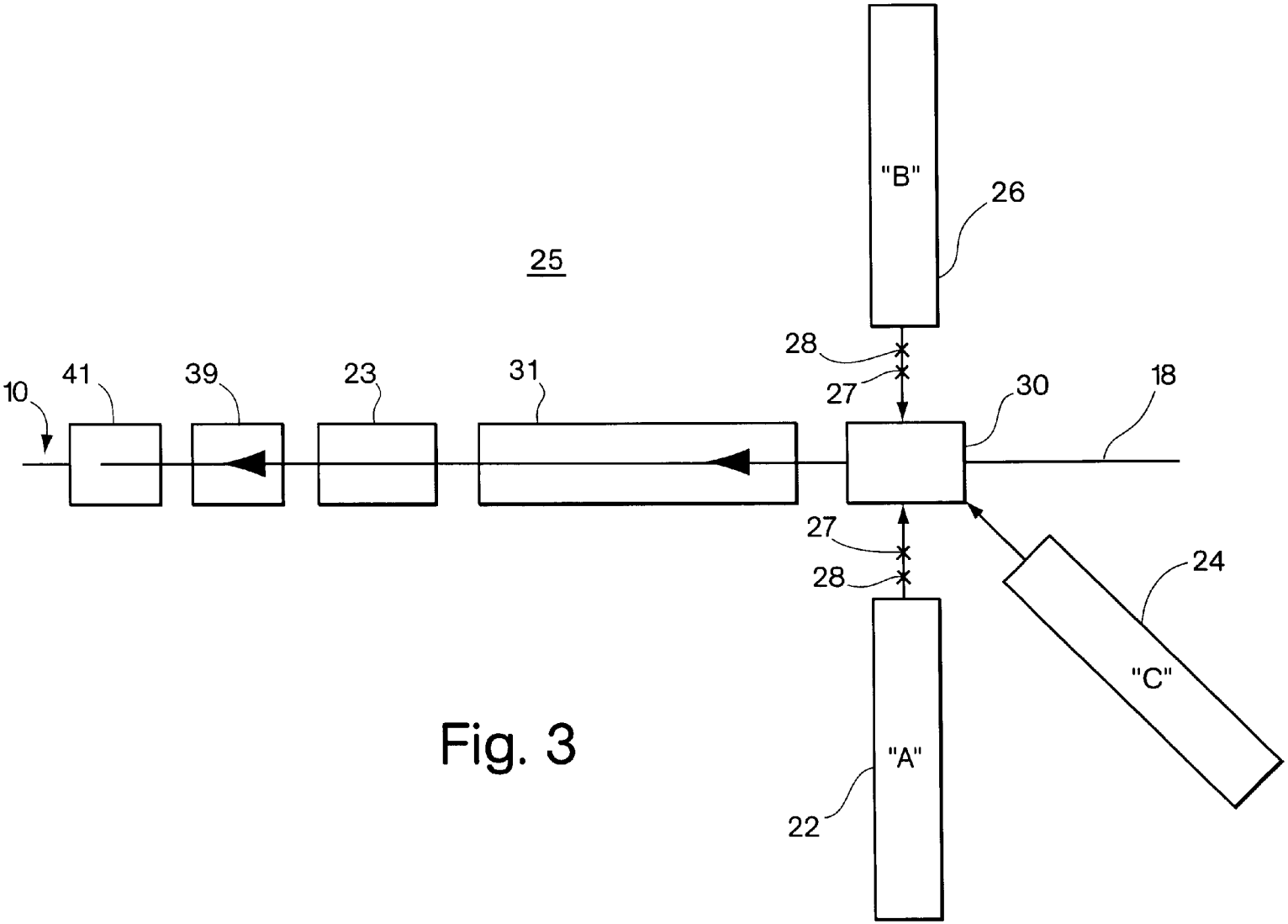
FIG. 3 is a schematic diagram of a system for producing a differential stiffness electrical cable using the co-extrusion technique of the present invention.

The present invention may be made by means of a co-extrusion process with a well known co-extrusion head 30, as shown schematically in FIG. 3. The co-extrusion head 30 is arranged to minimize volumes of all the flow channels therewithin. Such a flow head is shown in my U.S. Pat. No. 5,533,985, and incorporated herein by reference, in its entirety. The present invention thus provides for the production of an extruded power cable or conduit 10 with an electrical conductor 18 being co-extruded around one or more electrical conductors 13 with two or more thermoplastic resins "A", "B" and possibly "C" of varied thickness which can be automatically fed into the co-extrusion head and precisely synchronized fashion to produce a power cable or conduit having different resins or resin combinations in different longitudinal sections of the cable 10, always with gradual transition zones 16 from one to the other.

A unique characteristic of the invention is the gradual change and the controlled shorter length of the transition section 16 between a soft flexible portion 14 and a relatively stiff portion 12 of the extruded material about the conductive core 18 of the cable 10. The construction of the transition section 16 of the power cable or conduit 10, as may be seen in FIG. 1, comprises a layer of one material "A" or "B" forming a wedge shaped profile extending into another material "B" or "A" or "C". This construction is formed by a skewing volume which is not overly short and with a viscosity of the wedging material or resin not overly high not compared with the resin into which it is wedged.

In forming a power cable or conduit 10 of the present invention, one material or resin is always gradually combined with another material in the transition zone with some aspects of the resin forming a wedge structure circumferentially about the central conduit. In other configurations, the wedge may be in the form of a gradually fitting layer or in gradually changing the shapes such as multiple spear points. This wedge construction forms an extremely secure virtually unbreakable joinder between two resins because of the large surface area which also forms the region of greater flexibility of the resin thereof.

Referring more specifically to FIG. 3 there is shown schematically a system 25 for co-extruding different stiffness power cable or conduit 10. The system 25 includes the co-extrusion head 30 into which extruders feed the different resins such as a soft resin and a stiff resin which will be used to form the finished covering about the conductive core 18. For purposes of illustration, a first extruder 22 is arranged to provide a resinous stream for resin "A" which for example will ultimately form one of the flexible or less flexible insulating segments 12 or 14 of the cable 10 while a second extruder 26 provides a stream of resin "B" which will also form one of the less flexible or flexible insulating segments 14 or 12 of the power cable 10 about the conductive core 18. A third extruder 24 may be arranged to provide a resinous stream of resin "C" which is the material which can form an inside or outside layer of the power cable or conduit 10. A modulating member 27 and 28, regulates the flow of resins from each of the first and second extruders 22 and 26 into the co-extrusion head 30, which a second modulator may be used to bleed resin "A" from the head 30 to relieve residual pressure.

To produce a power cable or conduit with differential stiffness, the first and second modulators 27 and 28 are actuated periodically in synchronized fashion to abruptly stop or change the resin flow to the head 30. Because of the design of the co-extrusion head 30, the interface between the stiff resin and the soft resin is naturally sheared and elongated when flowing through channels of the head 30, as may be seen in FIG. 1. Thus, abrupt changes or stoppages by the first and second modulators result in a very gradual change of a stiff layer of predetermined thickness in the layering about the conductive core creating a gradual stiffness change and resulting in the wedge structure in the transition section of the power cable or conduit. After discharge from the extrusion head, the power cable may be cooled by passage through a water tank 31, with a puller 39 and a cutter 41 to form the power cable assembly system 25. The length of the transition section may also be changed by changing the viscosity of the resins, as described in my aforementioned U.S. Pat. Nos. 5,533,985 or 6,135,992.

It is apparent that changes and modifications may be made within the spirit and scope of the present invention, but it is my intention, however, only to be limited by the scope of the following claims.

As my invention,

I claim:

1. An elongated cable for the communication of electrical power from a source to an electrically powered device, said cable being foldable at predetermined locations along its length and comprising:

an elongated electrical conductor;

a first segment of thermoplastic resinous insulating material arranged about a linear segment of said elongated electrical conductor;

a second segment of thermoplastic resinous insulating material arranged about a second linear segment of said elongated electrical conductor, said first and second segments of insulating materials being different from one another, one of said first or second segments of insulating material being less stiff than a respective first or second segment of said insulating material.

2. The elongated cable as recited in claim 1 wherein said first segment of insulating material and said second segment of insulator material are adjacent to one another along said elongated electrical conductor.

3. The elongated cable as recited in claim 1 wherein said elongated electrical conductor has a plurality of first and second segments of insulating material disposed about its longitudinal length.

4. The elongated cable as recited in claim 3 wherein said first and second segments of insulating material are arranged in an alternating sequence with one another along said elongated electrical conductor.

5. The elongated cable as recited in claim 4 wherein said first and second segments of insulating material have transition zones therebetween of increasing or decreasing flexibility on its longitudinal direction.

6. A method of manufacturing an insulated electrical power cable with an insulator extruded therearound of alternating flexibility along its length, said cable being flexible at predetermined locations along its length, said method comprising the steps of arranging an extrusion head to receive a conductive wire therethrough;

attaching a first and a second insulating material extruder in communication with said head, said first and second insulating material extruders each extruding first and second thermoplastic, resinous insulating materials of different flexibility from one another when first and second insulating materials are cured;

directing said conductive wire through said head; and extruding said first and second insulating materials on said conductive wire to enclose alternating segments of the length of said conductive wire as said conductive wire is drawn from said head.

7. The method as recited in claim 6 including the step of tapering said first and second insulating materials with respect to one another in a transition zone juncture between said alternating segments of insulating materials.

8. The method as recited in claim 7 wherein said first and second insulating materials are of different stiffness from one another thereby forming a cable which more easily bends on one segment then the other whereby said cable can be stacked with the less flexible segments on other less flexible segments.

* * * * *